US006629324B1

(12) United States Patent
Shapiro

(10) Patent No.: US 6,629,324 B1
(45) Date of Patent: Oct. 7, 2003

(54) THERAPEUTIC PILLOW

(76) Inventor: Ritalee Shapiro, 758 Miller Dr., Fort Dodge, IA (US) 50101

( * ) Notice: Subject to any disclaimer, the term of this patent is extended or adjusted under 35 U.S.C. 154(b) by 0 days.

(21) Appl. No.: 09/866,328

(22) Filed: May 29, 2001

(51) Int. Cl.[7] ..... A47G 9/00
(52) U.S. Cl. ..... 5/636; 5/630
(58) Field of Search ..... 5/636, 630, 645, 5/637; D6/601

(56) References Cited

U.S. PATENT DOCUMENTS 2,295,906 A 9/1942 Lacour
3,829,917 A * 8/1974 De Laittre et al. ..... 5/636
D256,728 S 9/1980 Allen
5,018,231 A 5/1991 Wang
5,781,947 A * 7/1998 Sramek ..... 5/636
5,848,448 A 12/1998 Boyd
5,926,880 A 7/1999 Sramek
6,003,177 A * 12/1999 Ferris ..... 5/636
6,006,380 A 12/1999 Sramek

* cited by examiner

*Primary Examiner*—Heather Shackelford
*Assistant Examiner*—Fredrick Conley

(57) ABSTRACT

The present invention comprises a pillow specifically designed to avoid pressure on the ears, lobes and cartilage and to evenly distribute pressure on the other surfaces of the face. Its top surface is contoured such that the curvature of the head and neck is accommodated. The ears are protected by the presence of recesses in the top surface of the pillow which are shaped similarly to the ear with one generally arcuate side and one generally flat side and positioned somewhat closer to the front edge of the pillow. The recesses are of sufficient size and depth so that as a person lies his head on one side with one ear positioned in a recess, there is no pressure on the ear, its lobe, or cartilage. The pillow is especially effective for reducing the pain of recovery from lobe or cartilage piercings.

7 Claims, 5 Drawing Sheets

THERAPEUTIC PILLOW

BACKGROUND OF THE INVENTION

1. Field of the Invention

The present invention relates to therapeutic pillows and specifically pillows designed to alleviate pressure on certain portions of the head and neck. Conventional sleeping pillows are typically of a generally three dimensional rectangular shape and stuffed with or made from some soft, resilient material or material with memory such as foam rubber. When in use, conventional pillows make no specific accommodation for ears or head and neck curvature, which can exacerbate cramping, discomfort and earaches or increase the pain of recovery from lobe or cartilage piercings. Therefore, other pillows have been designed with the objective of preventing the problems of the conventional pillow.

2. Description of the Prior Art

There have been a number of patents granted for therapeutic pillows. Some include ridges for supporting a person's neck and/or top of the head. For example, U.S. Pat. Nos. 6,006,380 and 5, 926,880 to Sramek provide for a pillow constructed such that it includes a central depression for the head and its contours can be adjusted for the individual user by placement of shims. The top surface claims a small downward slope from the center to the sides. Depressions for the receipt of ears are in the top portion of these pillows but the shape, depth and placement of these ear depressions from the front edge of the pillow are not specified or discussed.

Another patent for a therapeutic pillow includes intersecting troughs in which ears, neck and the head rest. (See U.S. Pat. No. 5,018,231 to Wang). Wang provides troughs which act to lessen pressure on the ear, but do not provide a way for the ear to be substantially without pressure. And, although pressure on the ear may be somewhat alleviated, pressure on certain other parts of the face are disproportionately increased. Still others contemplate holes or cutouts from the edge of the pillow to its middle area in which some portion of the head or face rests (See U.S. Des. Pat. No. 256,728 to Allen and U.S. Pat. No. 2,295,906 to LaCour.) One negative aspect of pillows with cutouts is that the cutouts markedly weaken the pillow's structure. U.S. Pat. No. 5,848,448 to Boyd also provides for a solid foam body with cutouts through the body of the pillow. Boyd claims a pillow of "substantially rectangular" shape and does not contemplate any contour for the neck and head. The disclosure also does not address the size or shape of the holes relative to reducing pain in the ear.

It is an objective of the present invention to provide a pillow which allows a person to sleep comfortably supine or on either side without causing pain to the ear;

It is a further object of this invention to provide a pillow designed specifically for persons healing from ear or cartilage piercings;

It is a further object of this invention to provide a very affordable pillow of simple and durable design, preferably of one piece construction;

It is an additional objective to provide a pillow which facilitates a variety of sleeping positions and the transitions therebetween.

SUMMARY OF THE INVENTION

The present invention is a pillow specifically designed to be simple, yet effective, in its prevention of ear pain resulting from laying the side of one's head on a pillow, especially after piercing the ear cartilage or lobes. One feature of the pillow is that it encompasses gentle curvatures to echo those of the neck and head in any sleeping position.

A further feature of the invention comprises the two carefully shaped and placed recesses for ears in the top surface of the pillow. Due to the placement and shape of the recesses, when a sleeping person with a sore ear lays on the pillow and turns to either side, the sleeper's position adjusts itself to find the recess for the ear to avoid pain.

An additional feature of the present invention is that the design of the pillow leaves the entire ear free of any surface pressure or even tactile contact while at the same time the remainder of the pillow provides comfort for the head and neck whether the sleeper is supine or on his side.

Other objects, features, and advantages of the present invention will be readily appreciated from the following description. The description makes reference to the accompanying drawings, which are provided for illustration of the preferred embodiment. However, such embodiment does not represent the full scope of the invention. The subject matter which the inventor does regard as his invention is particularly pointed out and distinctly claimed in the claims at the conclusion of this specification.

DESCRIPTION OF THE PREFERRED EMBODIMENT(S)

Figure 1:
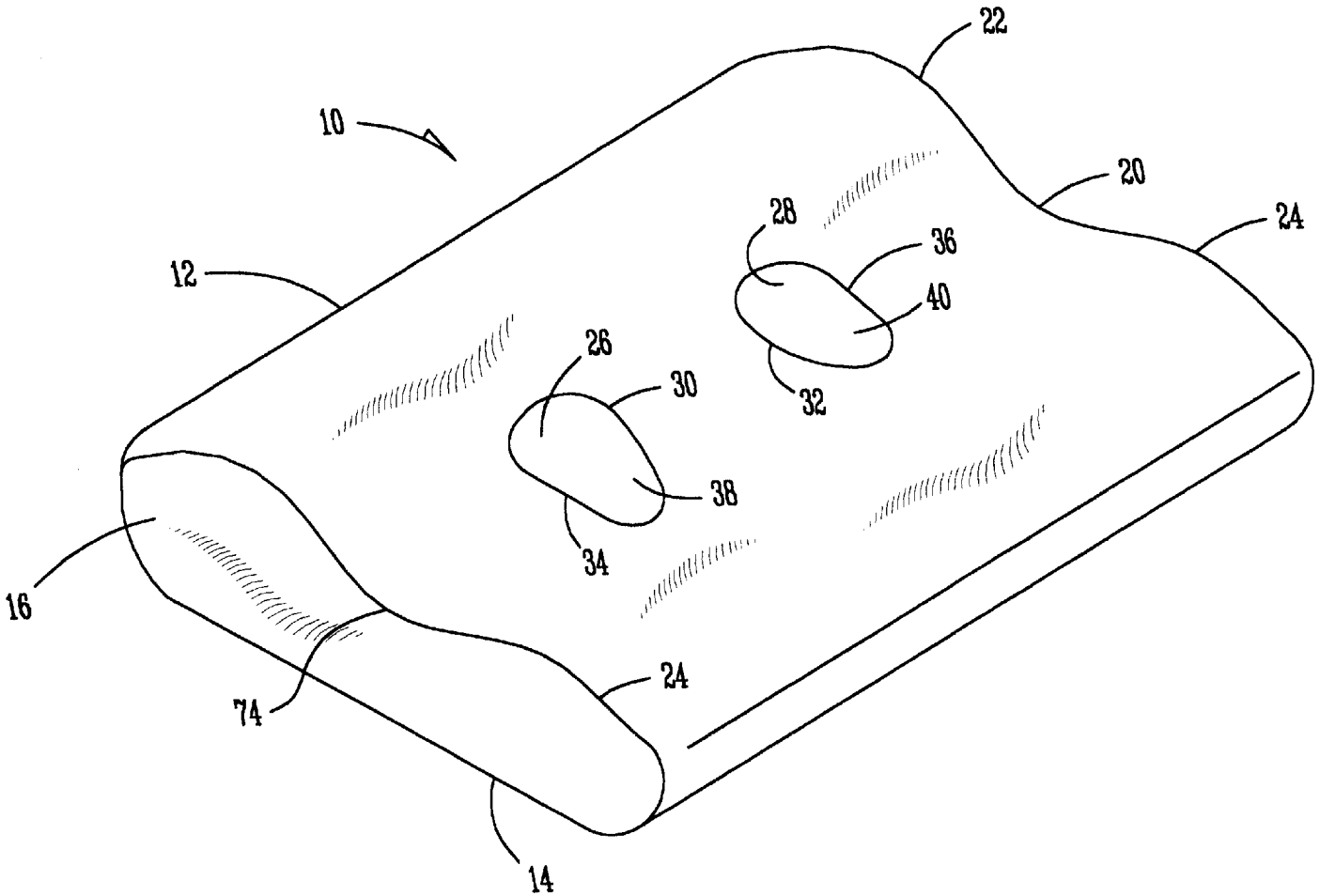
FIG. 1 shows a perspective view of the therapeutic pillow of the present invention.
Figure 2:
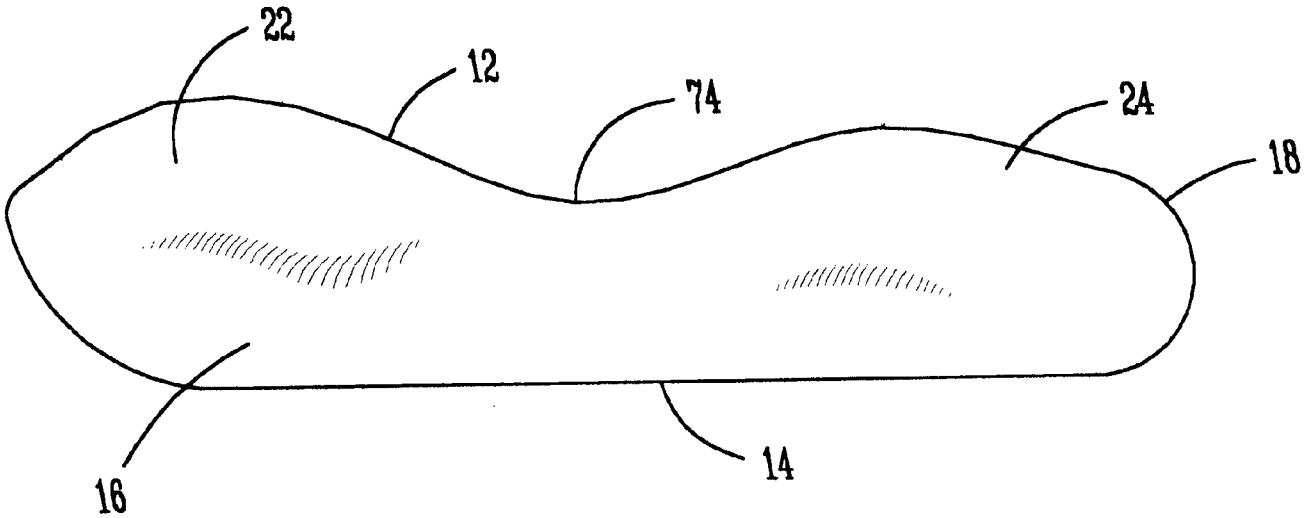
FIG. 2 is a side elevational view of the pillow of FIG. 1.
Figure 3:
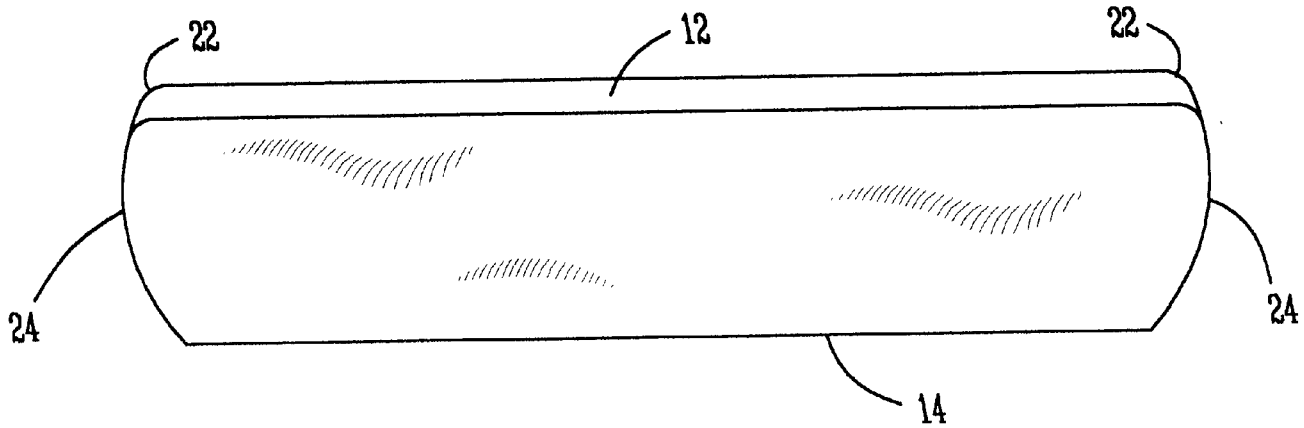
FIG. 3 is a front elevational view of the invention.

A preferred embodiment of a pillow 10 of the present invention is shown in FIG. 1. The pillow 10 comprises a top surface 12, and a bottom surface 14. There are two side surfaces 16, 20 which exhibit generally the contours of a peanut with a first lobe 22 and a second lobe 24. The top surface 12 is contoured such that it follows the contours of said lobes 22 and 24 of said side surfaces 16 and 20. The pillow 10 is preferably of one piece construction and made of a resilient material.

Positioned on the top surface 12 are two recesses 26 and 28. The recesses 26 and 28 each respectively have a similar shape with a generally arcuate side 30 and 32, a generally planar side 34 and 36 and a depth 38 and 40. Said recesses are positioned such that the arcuate sides 30 and 32 are nearest each other and the planar sides 34 and 36 are furthest from each other. Said recesses 26 and 28 are positioned somewhat closer to the second lobe 24 than to said first lobe 22. The recess 26 is the same distance from one of the side surfaces 16, 20 as recess 28 is from the other. The resilient material from which the pillow 10 is made dictates the depth 38 and 40 of the recesses 26 and 28; said depth 38, 40 must be sufficient such that when a round weight of up to 12 pounds is placed on the pillow the depth 38, 40 is not less than one inch.

Figure 4:
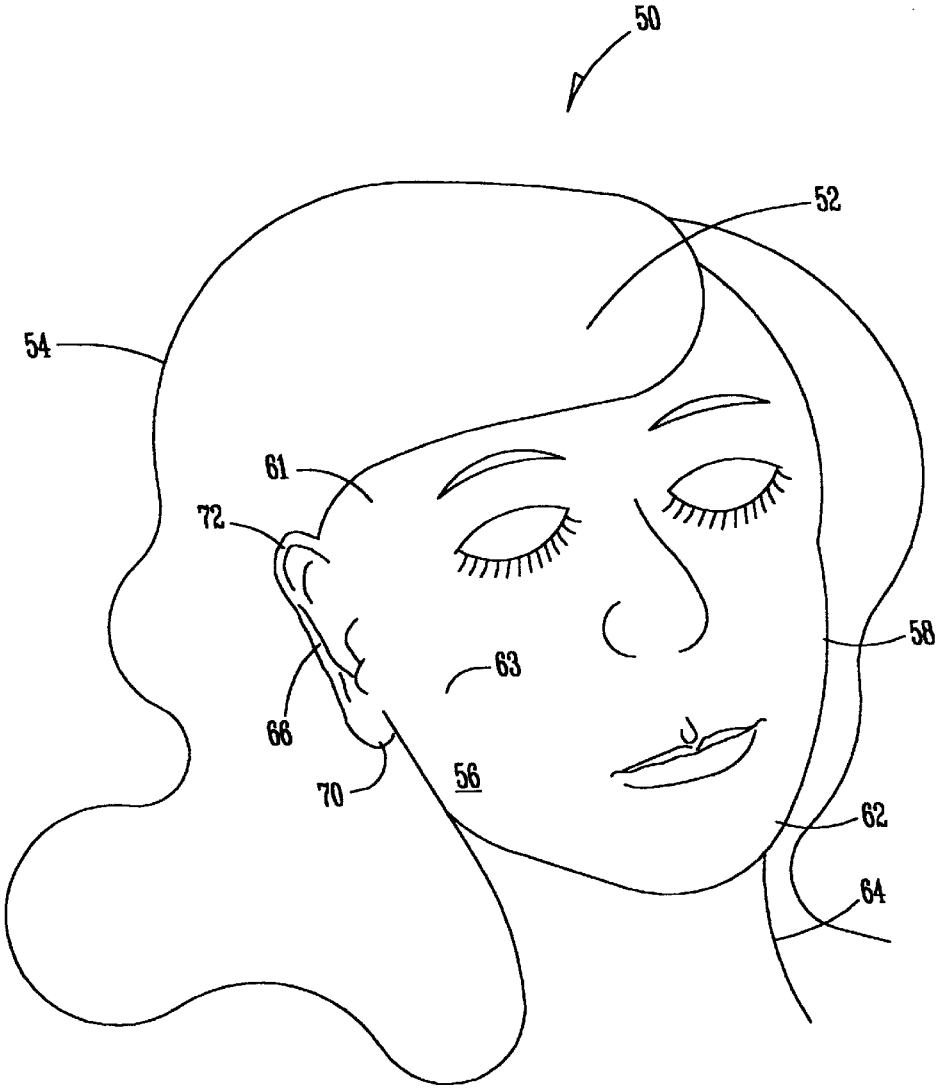
FIG. 4 is a perspective view of a human head.

Shown in FIG. 4 is a person 50 with head 52 including a back side 54, first and second sides 56 and 58, a plurality of facial surfaces 61, 62, 63, a neck 64, and two ears 66 and 68, each with an earlobe 70 and a portion of cartilage 72. The pillow 10 of the present invention provides comfort for the neck 64 and head 52 as well as the ears 66 or 68. If the person 50 lays the back side of his head 54 on the pillow 10, the second lobe 24 acts to support the neck 64 and a slight depression 74 created on the top surface 12 between said first lobe 22 and said second lobe 24 accommodates the head 52.

Figure 5:
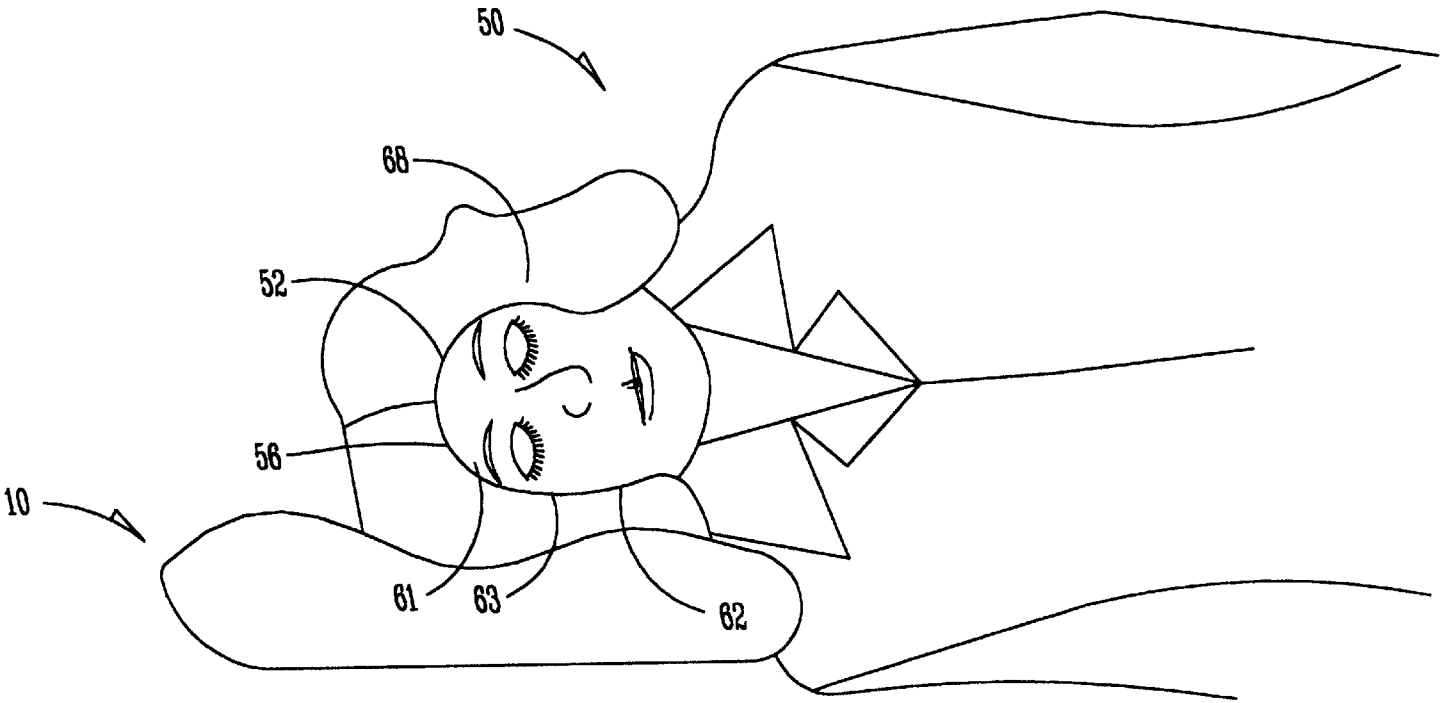
FIG. 5 is a perspective view of a sleeping person using the pillow.

Referring now to FIG. 5, if the person 50 lies his head 52 on said first side 56 on the pillow 10, said recess 26 accommodates the entire earlobe 70 and cartilage 72 of the ear 66. If the person 50 lays his head 52 on said second side 58 on the pillow 10, said recess 28 accommodates the entire lobe 70 and cartilage 72 of the ear 68. Each recess 26 or 28 provides plenty of room for the entire ear 66 or 68 but does not over-allow space, thereby maintaining support for all of the other facial surfaces 61, 62, 63 without disproportionate pressure on any. If a person 50 turns from laying supine with the back side of his head 54 on the pillow 10 to either the first side 56 or the second side 58, there is no impediment to the turn as there are no surfaces angled either up or down transverse to the direction of the turn. The first lobe 22 and second lobe 24 define the slight depression 74 between them where the head 52 rests and the lobes 22 and 24 act as guides so the person 50 easily locates a recess 26 or 28 upon turning to either side 56 or 58.

Thus, the present invention has been described in an illustrative manner. It is to be understood that the terminology that has been used is intended to be in the nature of words of description rather than of limitation.

Many modifications and variations of the present invention are possible in light of the above teachings. Therefore, within the scope of the appended claims, the present invention may be practiced otherwise than as specifically described.

What I claim is:

1. A therapeutic pillow comprising:

a) two side surfaces each having a first and a second lobe;

b) a bottom surface positioned between and adjacent to said side surfaces;

c) a top surface positioned between and adjacent to and shaped to conform to the first and second lobes of said side surfaces; and d) two recesses located in top surface and positioned closer to said second lobe than said first lobe comprising a periphery which has a generally straight portion and a generally arcuate section and positioned such that said arcuate sections of said peripheries are closest to each other and said generally straight portions of said peripheries are furthest from each other.

2. A therapeutic pillow as claimed in claim 1 wherein each of said recesses further comprise a bottom surface and a depth of sufficient magnitude such that a round shaped object of up to 12 pounds placed on said pillow depresses said depth of said recesses to no less than one inch.

3. A therapeutic pillow comprising:

a) two side surfaces with rounded peripheral contours;

b) a generally top surface area and a generally bottom surface area positioned between said side surfaces and which conform with the contours of said side surfaces; and c) a pair of recesses located in said top surface area each comprising a periphery with a generally straight portion and an arcuate portion, a depth, and an inner surface.

4. A therapeutic pillow comprising:

a) two side surfaces with rounded perpheral contours;

b) a generally top surface area and a generally bottom surface area positioned between said side surfaces and which conform with the contours of said side surfaces;

c) a pair of recesses located in said top surface area each comprising a periphery with a generally straight portion and an arcuate portion, a depth, and an inner surface; and d) said recesses are oriented such that said arcuate portions of said peripheries are nearer each other than are said generally straight portions and the two recesses are mirror images of each other.

5. A therapeutic pillow comprising:

a) a generally top surface and a generally bottom surface each comprising a front zone and a rear zone;

b) a first side surface and a second side surface each having a contoured periphery;

c) a length, a width, and a plurality of depths comprising said first and second side surfaces positioned in a spaced apart manner and at right angles to said top surface and said bottom surface;

d) a first and a second recess in said top surface and closer to said front zone than to said rear zone; and e) said recesses each further comprising a periphery with a generally straight portion and an arcuate portion.

6. A therapeutic pillow comprising:

a) a generally top surface and a generally bottom surface each comprising a front zone and a rear zone;

b) a first side surface and a second side surface each having a contoured periphery;

c) a length, a width, and a plurality of depths comprising said first and second side surfaces positioned in a spaced apart manner and at right angles to said top surface and said bottom surface;

d) a first and a second recess in said top surface and closer to said front zone than to said rear zone wherein each recess further comprises a depth no less than one inch with a generally round weight of up to 12 pounds on said pillow; and e) said recesses each further comprising a periphery with a generally straight portion and an arcuate portion.

7. The therapeutic pillow claimed in claim 6 wherein said first recess is positioned such that said straight portion of said periphery is generally parallel to and nearer said first side surface than is said arcuate portion and said straight portion of said periphery of said second recess is generally parallel to and nearer said second surface than is said arcuate portion.

* * * * *